US011491524B2

(12) United States Patent
Dal Cerro et al.

(10) Patent No.: US 11,491,524 B2
(45) Date of Patent: Nov. 8, 2022

(54) PRODUCTION INSTALLATION HAVING A MANIPULATION DEVICE

(71) Applicant: TRUMPF Maschinen Austria GmbH & Co. KG., Pasching (AT)

(72) Inventors: Roberto Dal Cerro, Lonigo (IT); Matteo Dal Lago, Cologna Veneta (IT); Stefano Speziali, Foligno (IT)

(73) Assignee: TRUMPF Maschinen Austria GmbH & Co. KG, Pasching (AT)

( * ) Notice: Subject to any disclaimer, the term of this patent is extended or adjusted under 35 U.S.C. 154(b) by 639 days.

(21) Appl. No.: 16/341,148

(22) PCT Filed: Oct. 18, 2017

(86) PCT No.: PCT/AT2017/060270
§ 371 (c)(1),
(2) Date: Apr. 11, 2019

(87) PCT Pub. No.: WO2018/071938
PCT Pub. Date: Apr. 26, 2018

(65) Prior Publication Data

US 2020/0188979 A1 Jun. 18, 2020

(30) Foreign Application Priority Data

Oct. 20, 2016 (AT) ..... A 50957/2016

(51) Int. Cl.
*B21D 5/04* (2006.01)
*B21D 43/10* (2006.01)
(Continued)

(52) U.S. Cl.
CPC ..... *B21D 5/04* (2013.01); *B21D 43/105* (2013.01); *B21D 5/0281* (2013.01); *B21D 43/11* (2013.01)

(58) Field of Classification Search
CPC ..... B21D 5/04; B21D 5/0281; B21D 43/04; B21D 43/10; B21D 43/11; B21D 43/105
(Continued)

(56) References Cited

U.S. PATENT DOCUMENTS 4,242,898 A 1/1981 Salvagnini
4,573,861 A 3/1986 Aschauer
(Continued)

FOREIGN PATENT DOCUMENTS

CN 102712022 A 10/2012
DE 28 39 978 A1 3/1979
(Continued)

OTHER PUBLICATIONS

International Search Report in PCT/AT2017/060270, dated Feb. 20, 2018.

*Primary Examiner* — Teresa M Ekiert
(74) *Attorney, Agent, or Firm* — Collard & Roe, P.C.

(57) ABSTRACT

A production installation for producing workpieces from sheet metal by reshaping includes a bending machine, a support table defining a support plane, and a manipulation device having a support arrangement and a holding arrangement. The holding arrangement has interacting upper and lower holding units. The support arrangement has a separate upper support unit and a separate lower support unit, wherein the upper holding unit is arranged on the upper support unit, and the lower holding unit is arranged on the lower support unit. In an open insertion position of the manipulation device for the sheet metal to be accommodated therein, and in a loading region in front of the bending machine, the upper support unit, together with the upper holding unit, is arranged entirely above the support plane, and the lower support unit, together with the lower holding unit, is arranged entirely below the support plane.

11 Claims, 4 Drawing Sheets

Figure 1:
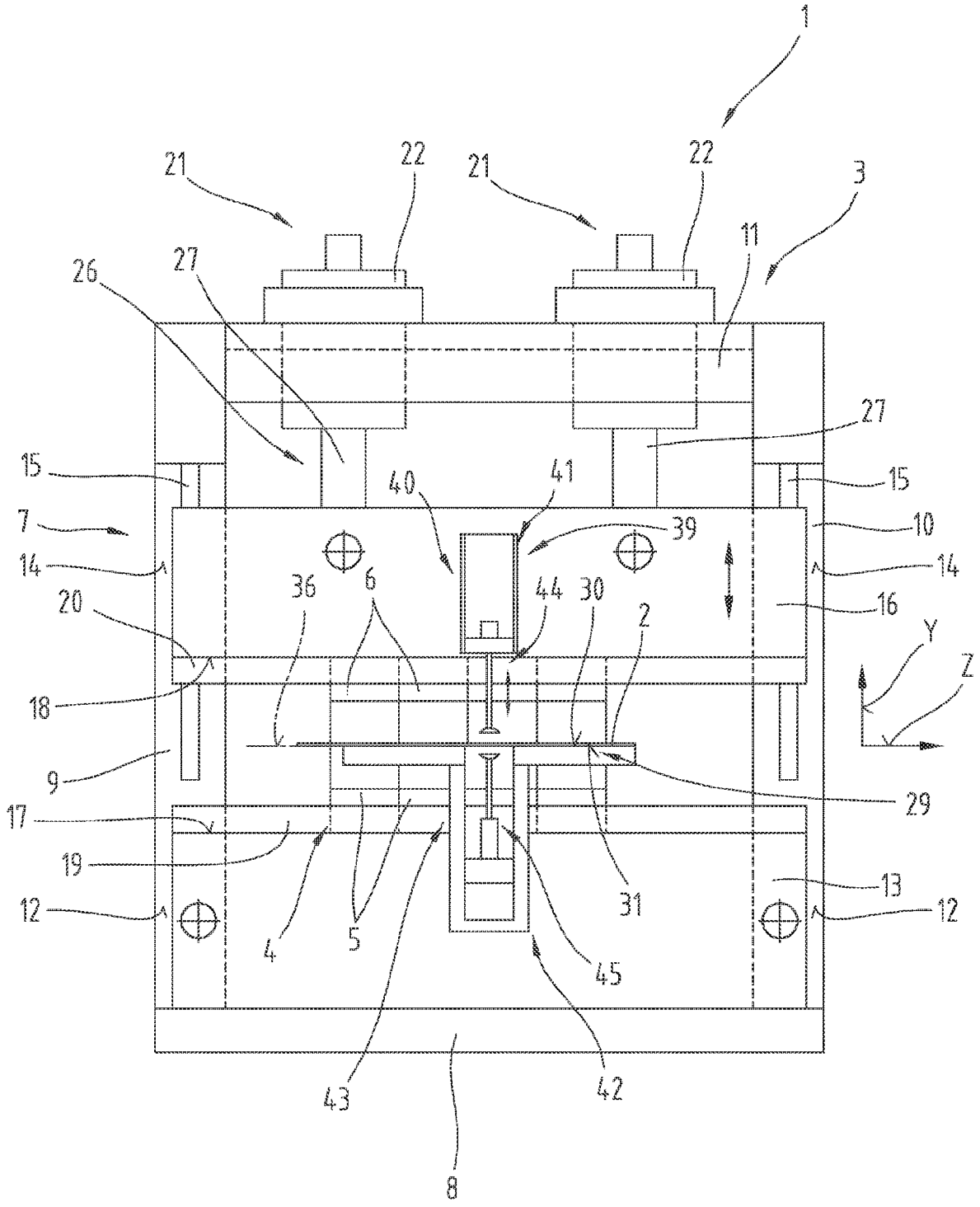

(51) Int. Cl.
*B21D 5/02* (2006.01)
*B21D 43/11* (2006.01)

(58) Field of Classification Search
USPC ..... 72/295, 296, 319
See application file for complete search history.

(56) References Cited

U.S. PATENT DOCUMENTS

| | | | | |
|---|---|---|---|---|
| 5,343,727 | A | 9/1994 | Osaka | |
| 5,528,818 | A | 6/1996 | Warneke | |
| 5,979,214 | A | 11/1999 | Fetsch et al. | |
| 9,339,860 | B2 | 5/2016 | Denkmeier | |
| 2015/0273779 | A1* | 10/2015 | Daub | B30B 1/10 100/264 |

FOREIGN PATENT DOCUMENTS

| | | | |
|---|---|---|---|
| DE | 42 22 741 | A1 | 4/1993 |
| DE | 4222741 | A1 | 4/1993 |
| DE | 196 21 658 | A1 | 12/1997 |
| DE | 196 39 590 | A1 | 4/1998 |
| EP | 0 097 637 | A2 | 1/1984 |
| JP | H6510487 | A | 11/1994 |
| JP | H11-342425 | A | 12/1999 |
| JP | 2001-191118 | A | 7/2001 |
| JP | 2001-269736 | A | 10/2001 |
| JP | 2002-160017 | A | 6/2002 |
| JP | 2003-311333 | A | 11/2003 |
| JP | 2006-102770 | A | 4/2006 |
| JP | 4091121 | B2 | 5/2008 |
| WO | 2007/125900 | A1 | 11/2007 |

* cited by examiner

PRODUCTION INSTALLATION HAVING A MANIPULATION DEVICE

CROSS REFERENCE TO RELATED APPLICATIONS

This application is the National Stage of PCT/AT2017/060270 filed on Oct. 18, 2017, which claims priority under 35 U.S.C. § 119 of Austrian Application No. A 50957/2016 filed on Oct. 20, 2016, the disclosure of which is incorporated by reference. The international application under PCT article 21(2) was not published in English.

The invention relates to a production system for production of workpieces made of sheet metal, in particular by means of forming by means of a bending procedure.

DE 28 39 978 A1 describes a production system for production of workpieces made of a metal sheet by means of forming of the same, which system is configured according to the stated type. The production system comprises a bending machine, a support table, and a manipulation apparatus. The bending machine in turn comprises a machine frame that is fixed in place, and an upper and a lower clamping beam disposed on the frame, wherein one of the clamping beams is adjustable relative and with reference to the machine frame, so as to hold the workpiece to be produced between clamping jaws disposed on the clamping beams, in each instance, with a clamping effect, at least during the bending procedure. The support table, with its support surface, defines a support plane for the metal sheet or the workpiece to be produced. The manipulation apparatus comprises a support arrangement and a holding arrangement, wherein the holding arrangement has an upper holding unit and a lower holding unit that interacts with the former. The support arrangement is configured in C shape and surrounds the metal sheet to be manipulated with its two shanks, which stand in connection with one another by means of a vertical connection crosspiece. The entire support arrangement is adjustable in the perpendicular direction with regard to the bending region defined by the clamping jaws. It is disadvantageous, in this regard, that a support arrangement configured in solid manner must be displaced as a total unit for manipulation of the metal sheet. Furthermore, direct access to the charging side is blocked by the connection crosspiece, and in addition, the free space for manipulation present between the holding units and the connection crosspiece is limited by the shank lengths.

DE 196 39 590 A1 also describes a bending center configured in accordance with the type, for the production of workpieces made from a metal sheet by means of forming. The bending center comprises a bending machine, a support table, and a manipulation apparatus having two manipulators that are independent of one another. The bending machine in turn comprises a fixed machine frame and upper and lower clamping beams held on it, wherein one of the clamping beams is adjustable relative and with reference to the machine frame, so as to hold the workpiece to be produced, during the bending procedure, between clamping jaws disposed on the clamping beams, with a clamping effect, in each instance. The support table, with its support surface, defines a support plane for the metal sheet or the workpiece to be produced. The second manipulator comprises a support arrangement and a holding arrangement, wherein the holding arrangement has an upper holding unit and a lower holding unit that interacts with the former. The two support arrangements are formed by means of linear guides, on which the holding unit guided on them can be adjusted by means of threaded spindles, in each instance.

Furthermore, the two support arrangements are attached to a housing of the bending cell, in each instance, and connected with one another, at their ends that face away from the housing of the bending cell, with a vertical crosspiece. The common spindle drive is also disposed in this end region. The lower threaded spindle is driven directly by a drive motor, wherein the rotational movement is transferred from the lower threaded spindle to the upper threaded spindle by an endless connection means. Here, direct access from the charging side is also blocked by the vertical crosspiece and the drive connection between the threaded spindles. For this reason, here only a feed direction of the metal sheet to be bent, oriented in the parallel direction with reference to the bending edge, into the charging region situated in front of the bending machine is possible.

DE 42 22 741 A1 describes a production line for the production of a steel cassette for ceiling and/or wall constructions composed of a sheet-metal panel. The production line also comprises a punching station that precedes the swivel bending station in the transport direction of the sheet-metal panel in a parallel orientation with reference to the bending edge of this station, and a welding station that follows it. A ball roller table is disposed in a charging region situated in front of the swivel bending station, for setting the sheet-metal panel down. The swivel bending station comprises a fixed press table for holding the sheet-metal panel in clamped manner, and a pivoting hold-down device having a height adjustment arrangement. Furthermore, the swivel bending station comprises a manipulator having an extension arm that projects into the charging region situated in front of the bending machine. The extension arm can be adjusted in a parallel orientation with reference to the bending edge of the swivel bending station. A gripper that can be displaced in terms of its longitudinal expanse and rotated about a vertical axis is guided on the extension arm. The sheet-metal panel is gripped by the gripper at the fitting holes provided in the sheet-metal panel or at carrier bolts affixed to it, and displaced in accordance with the forming steps provided. In this regard, the sheet-metal panel constantly remains lying on the ball roller table, and its position is changed only in this support plane. Supportive further transport between the work stations can take place by means of a running carriage in combination with the gripper.

U.S. Pat. No. 5,343,727 A describes a further production system for production of workpieces from a metal sheet by means of forming. The production system comprises a bending machine, a support table formed by circulating transport belts, and a stationary clamping apparatus situated between the transport belts. The bending machine in turn comprises a fixed machine frame and an upper and a lower clamping beam held on it, wherein one of the clamping beams is adjustable relative and with reference to the machine frame, so as to hold the workpiece to be produced, at least during the bending procedure, between clamping jaws disposed on the clamping beams, in each instance, with a clamping effect. When the metal sheet to be bent is situated in a bending position, the upper, adjustable part of the clamping apparatus is adjusted in the direction toward the lower part of the clamping apparatus, and thereby the metal sheet is held in position. In this regard, this is exclusively an additional clamping apparatus and not a manipulation apparatus for changing the position of the metal sheet. It cannot be derived how the parts of the clamping apparatus and with what components the parts of the clamping apparatus are held or attached relative and with reference to the bending machine.

An apparatus for feed of sheet-metal panels to a bending machine has become known from EP 0 097 637 A2. The apparatus consists of a carriage that can be disposed on a frame and carries a tensioning device for the sheet-metal panel. The carriage forms a frame having posts that project upward on the side, and a crossbeam connecting the posts on the side facing away from the carriage. The upper tensioning jaw of the tensioning device is disposed on the crossbeam and can be adjusted in the direction toward the two fixed lower tensioning jaw by means of a tensioning cylinder, so as to hold the sheet-metal panel in clamping manner. Furthermore, a boom that projects upward from the frame is disposed on the frame that carries the carriage. The boom is disposed on the side of the carriage that faces away from the bending machine, and carries the rotational drive for the sheet-metal panel. The rotation drive comprises a drivable clamping jaw having an axis of rotation oriented perpendicular to the clamping plane of the sheet-metal panel. In order to be able to carry out displacement of the sheet-metal panel about the axis of rotation of the rotational drive, the carriage must be adjusted, on the side facing away from the bending machine, toward the boom having the rotational drive. When the upper clamping jaw is situated above the clamping jaw of the rotational drive in the vertical direction, the clamping jaw of the rotational drive grips onto the underside of the sheet-metal panel, reaching through between the two lower tensioning jaws disposed at a distance from one another. The clamping jaw of the rotational drive interacts with the upper tensioning jaw as a counter-jaw. The charging region in front of the bending machine is interrupted and delimited here by the posts that project upward at the side from the carriage.

DE 196 21 658 A1 describes a further production system of the stated type. This system also comprises a bending machine, a support table, and a manipulation apparatus. The bending machine in turn comprises a machine frame that is fixed in place and an upper and a lower clamping beam held on the frame, wherein one of the clamping beams is adjustable relative and with reference to the machine frame, so as to hold the workpiece to be produced between clamping jaws disposed on the clamping beams, in each instance, with a clamping effect, at least during the bending procedure. The support table, with its support surface, defines a support plane for the metal sheet or the workpiece to be produced. The manipulation apparatus comprises a support arrangement and a holding arrangement, wherein the support arrangement is held on the machine frame and is situated above the support plane. The entire holding arrangement is guided on the support arrangement, in adjustable manner, in the perpendicular direction with reference to a bending region defined by the clamping jaws, and comprises an upper holding unit and a lower holding unit that interacts with the former, wherein the two holding units form a type of gripper. The holding units can furthermore be jointly adjusted, in terms of their position, about a vertically oriented axis of rotation. It is disadvantageous, in this regard, that one of the holding units projects above the support plane and here, too, the manipulation space is not available without interruptions for placement and manipulation of the metal sheet or of the workpiece.

It was the task of the present invention to overcome the disadvantages of the state of the art and to make available a production system by means of which a user or an automated feed apparatus is able to undertake simple charging of the bending machine with the metal sheet to be processed or the workpiece to be processed further, without disruptive parts of the manipulation apparatus. Furthermore, the manipulation speed is also supposed to be increased by reducing the moved masses.

This task is accomplished by means of an apparatus in accordance with the claims.

The production system according to the invention serves for production of workpieces made of sheet metal, in particular by means of forming, the production system comprising:

- a bending machine having a machine frame that is fixed in place, a lower clamping beam having at least one lower clamping jaw held on it, as well as an upper clamping beam having at least one upper clamping jaw held on it, wherein one of the clamping beams is adjustable relative and with reference to the machine frame, so as to hold the workpiece to be produced between the two clamping jaws, with a clamping effect, at least during the bending procedure,
- a support table, which support table defines a support plane for the metal sheet or the workpiece to be produced with its support surface,
- a manipulation apparatus having a support arrangement and having a holding arrangement, wherein the holding arrangement comprises an upper holding unit and a lower holding unit that interacts with the former, and wherein the manipulation apparatus, which is situated in a front region of the bending machine, is adjustable for manipulation of the metal sheet or of the workpiece to be produced, from an open insertion position into a clamping position that clamps the metal sheet or the workpiece, and, in this regard,
- the support arrangement has an individual upper support unit and an individual lower support unit,
- the upper support unit is disposed above the support plane,
- the lower support unit is disposed below the support plane,
- the upper holding unit is guided on the upper support unit and can be adjusted by means of a first drive unit,
- the lower holding unit is guided on the lower support unit and can be adjusted by means of a second drive unit,
- the upper holding unit is disposed on the machine frame and/or on the upper clamping beam,
- the lower holding unit is disposed on the machine frame and/or on the lower clamping beam, and furthermore

- in an insertion position of the manipulation apparatus, which position is open to hold the metal sheet to be manipulated or the workpiece to be produced, as well as in a charging region in front of the bending machine, the upper support unit, together with the upper holding unit, is disposed completely above the support plane, and the lower support unit, together with the lower holding unit, is disposed completely below the support plane
- so that a free manipulation space, without interruptions, for holding and manipulation of the workpiece to be processed is present in the front region of the bending machine.

The advantages achieved in this way lies in that the support arrangement is formed by an independent upper support unit and an independent lower support unit, which support units are disposed, in each instance, on both sides of the support plane, namely above and below it. By means of this spatial vertical separation of the support units from one another, it also becomes possible to also dispose the holding elements for clamping holding of the metal sheet or of the workpiece, which elements are disposed on the support units, in each instance, in such a manner that the upper holding unit is disposed completely above the support plane and the lower holding unit is disposed completely below the support plane. In this way, sufficient free space for manipulation can be created in the front region of the bending machine between the holding units, which space is available without interruption for holding and manipulating the metal sheet or the workpiece to be processed. In this way, it becomes possible for an operator or for a further manipulation apparatus to bring the metal sheet to be processed or the workpiece to be processed further into the region of the support table, from the front side or charging side of the bending machine, and to be able to feed it in by means of the individual manipulation apparatus.

Furthermore, because of the placement of the two support units, separated spatially from one another, having the holding units disposed on them, in each instance, grasping and clamping of the metal sheet or of the workpiece to be processed further, which is possible in the movement region or handling region of the manipulation apparatus, can take place without hindrance. Furthermore, however, as a result, the clamping point or clamping region of the manipulation apparatus on the respective metal sheet or workpiece can also be freely selected in the region of effect of the manipulation apparatus, without possible collisions of the metal sheet or of the workpiece with parts of the manipulation apparatus having to be taken into consideration.

Since the upper support unit is disposed on the machine frame and/or on the upper clamping beam, the mass of moving parts for carrying out the manipulation procedures is thereby reduced. Furthermore, however, in this way the system effort and expenditure for the support constructions that are otherwise usual is also reduced.

The lower support unit is also disposed on the machine frame and/or on the lower clamping beam. As a result, space-saving and solid hold of the lower support unit is also achieved. Furthermore, however, in this way the moving masses for carrying out the manipulation movement are also kept relatively low.

Furthermore, it is advantageous if the upper holding unit is structured to be adjustable on the upper support unit. As a result, a clear displacement path of the upper holding unit on the upper support unit is established.

The lower holding unit is also structured to be adjustable on the lower support unit. As a result, a clearly predetermined displacement path of the lower holding unit on the lower support unit is also established.

Another embodiment is characterized in that the upper holding unit is configured to be adjustable in the perpendicular direction with reference to a bending region defined by at least one of the clamping jaws and in the parallel direction with reference to the support plane. In this way, a clearly predefined displacement path and a clear displacement direction of the upper holding unit can be established relative and with reference to the bending machine.

A further embodiment is characterized in that the lower holding unit is configured to be adjustable in the perpendicular direction with reference to a bending region defined by at least one of the clamping jaws and in the parallel direction with reference to the support plane. Thereby a clearly predefined displacement path and a clear displacement direction of the lower holding unit can be established relative and with reference to the bending machine.

Another embodiment is characterized in that the upper holding unit and the lower holding unit are structured to be adjustable jointly and synchronous to one another. By means of the adjustment of the two holding units in a manner synchronous to one another and simultaneously, on the support units assigned to them, perfect manipulation of the metal sheet or of the workpiece can nevertheless be carried out by the two holding units, which are otherwise independent of one another. The joint adjustment or adjustment movement, synchronous to one another, can be carried out by means of drive units that are coordinated with one another, by means of predefined adjustment movements, in the machine controller.

A further preferred embodiment is characterized in that the upper holding unit has at least one upper holding element, and the lower holding unit has at least one lower holding element. By means of providing individual holding elements on each of the holding units, in each instance, a defined holding effect can be exerted on the metal sheet or workpiece in this way. Furthermore, however, the mass of the components required for manipulation can be kept relatively low.

Furthermore, it can be advantageous if at least one of the holding elements can be pivoted about an axis of rotation oriented in the perpendicular direction with reference to the support plane. In this way, re-orientation of the planned bending line on the metal sheet or workpiece with reference to the bending region defined by the clamping jaws can also take place, in addition to a straight-line adjustment movement. This re-orientation can be carried out by means of a rotational movement of the metal sheet in a parallel position with reference to the support plane, so as to be able to undertake the re-orientation in the smallest possible space. Preferably, so as to carry out the rotation and/or pivoting procedure of the metal sheet, slight raising or lowering of the metal sheet in the vertical direction with reference to the support plane can be carried out before the pivoting procedure is carried out.

Another alternative embodiment is characterized in that at least one of the holding elements is configured to be adjustable in the perpendicular direction, with reference to the support plane, in the direction toward the other holding element, which is disposed opposite to it with reference to the support plane, in each instance. In this way, adaptation of the respective holding element in terms of height to the respective position of the metal sheet or workpiece to be manipulated can be carried out.

A further possible and, if applicable, alternative embodiment has the characteristics that the lower holding unit comprises a lower support element, and that the lower support element is structured to be adjustable on the lower support unit, in the perpendicular direction, with reference to a bending region defined by at least one of the clamping jaws, as well as in the parallel direction with reference to the support plane. In this way, even better support of the metal sheet or of the workpiece to be supported can be achieved by means of providing at least one lower support element. Furthermore, in this way not only can additional support of the metal sheet or workpiece directly situated in processing take place, but rather, at the same time and independently, pre-positioning of a metal sheet or workpiece to be processed subsequently can take place by means of the holding elements. As a result, down times of the bending machine can be further reduced and the efficiency of the machine can be additionally increased.

A further embodiment provides that the lower support element is configured to be adjustable in the perpendicular direction with reference to the support plane, in the direction toward the upper support unit disposed to lie opposite with reference to the support plane. In this way, adaptation of the holding elements, in terms of height, to the current location and position of the metal sheet or of the workpiece to be processed further can take place.

Another embodiment is characterized in that the lower holding element is structured to be adjustable on the lower support unit independent of the lower support element. In this way, a manipulation procedure that can be carried out even more efficiently can be achieved, and in addition, machine down times can also be reduced.

A further preferred embodiment is characterized in that at least one of the holding units, in particular the upper holding unit, has a toggle lever arrangement, by means of which toggle lever arrangement the at least one holding element is configured to be adjustable in the perpendicular direction with reference to the support plane, from the open insertion position into the clamping position. Simple mechanical clamping of the metal sheet or workpiece between the holding elements can be created by means of providing a toggle lever arrangement. Furthermore, however, the adjustment forces or press-down forces to be applied for clamping can also be reduced.

Furthermore, it can be advantageous if the upper support unit is disposed on the machine frame and/or on the upper clamping beam. In this way, the mass of moving parts for carrying out the manipulation procedures can be reduced. Furthermore, however, in this way the system effort and expenditure for support constructions that are otherwise usual can also be reduced.

Finally, another embodiment is characterized in that the lower support unit is disposed on the machine frame and/or on the lower clamping beam. In this way, space-saving and solid hold of the lower support unit can also be achieved. Furthermore, however, in this way the moving masses for carrying out the manipulation movement can also be kept relatively low.

For a better understanding of the invention, it will be explained in greater detail using the following figures.

Figure 2:
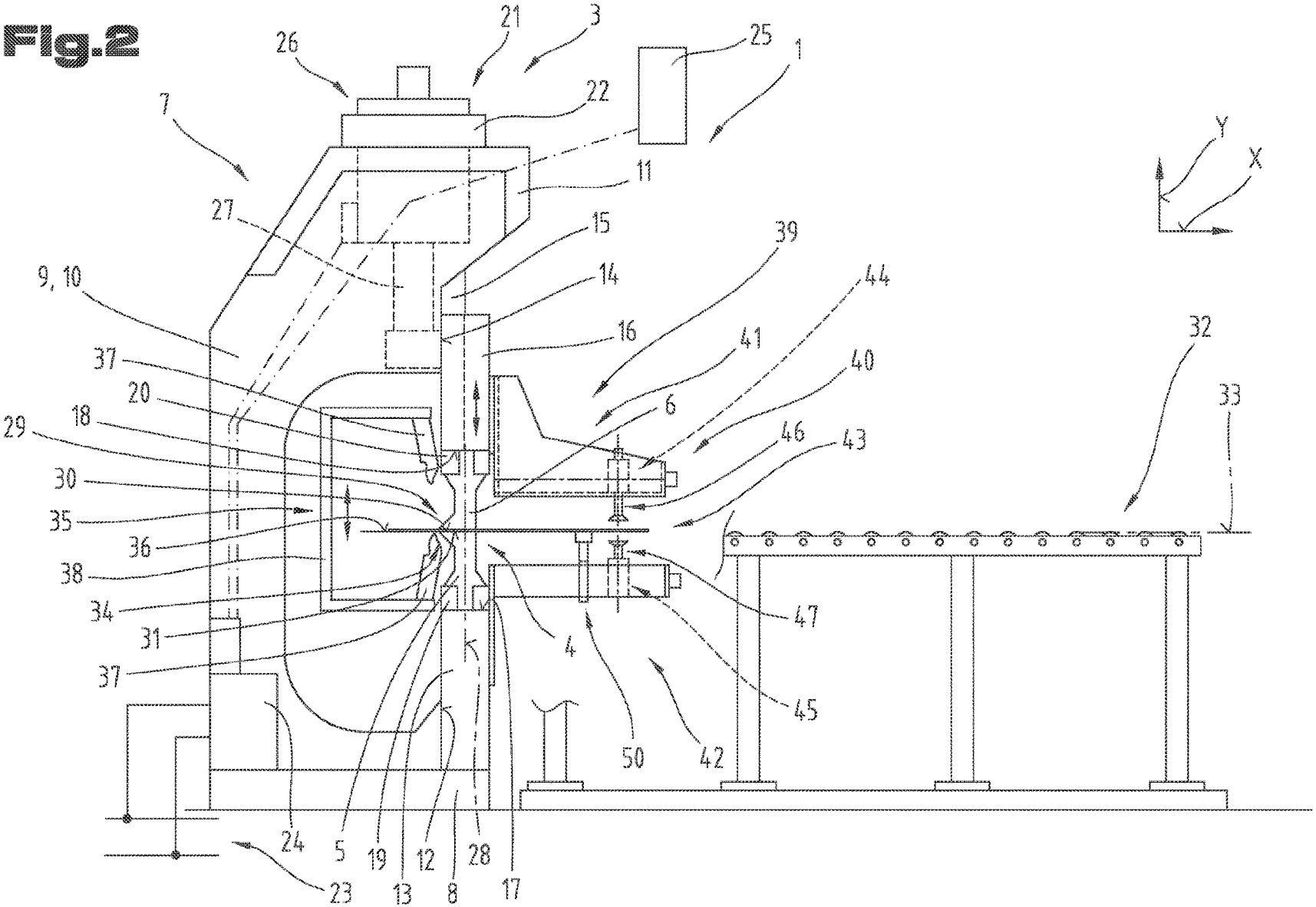
Figure 3:
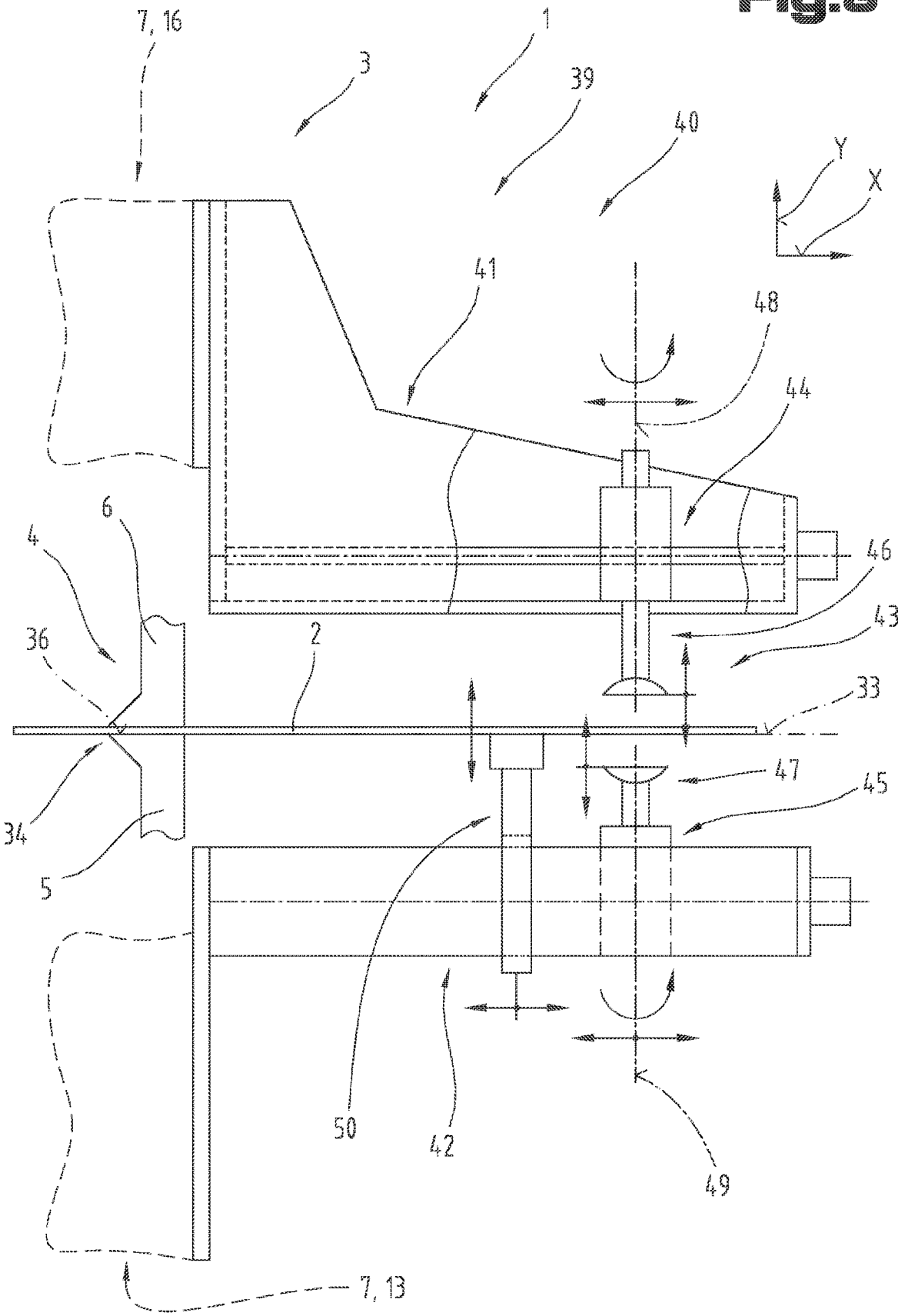
Figure 4:
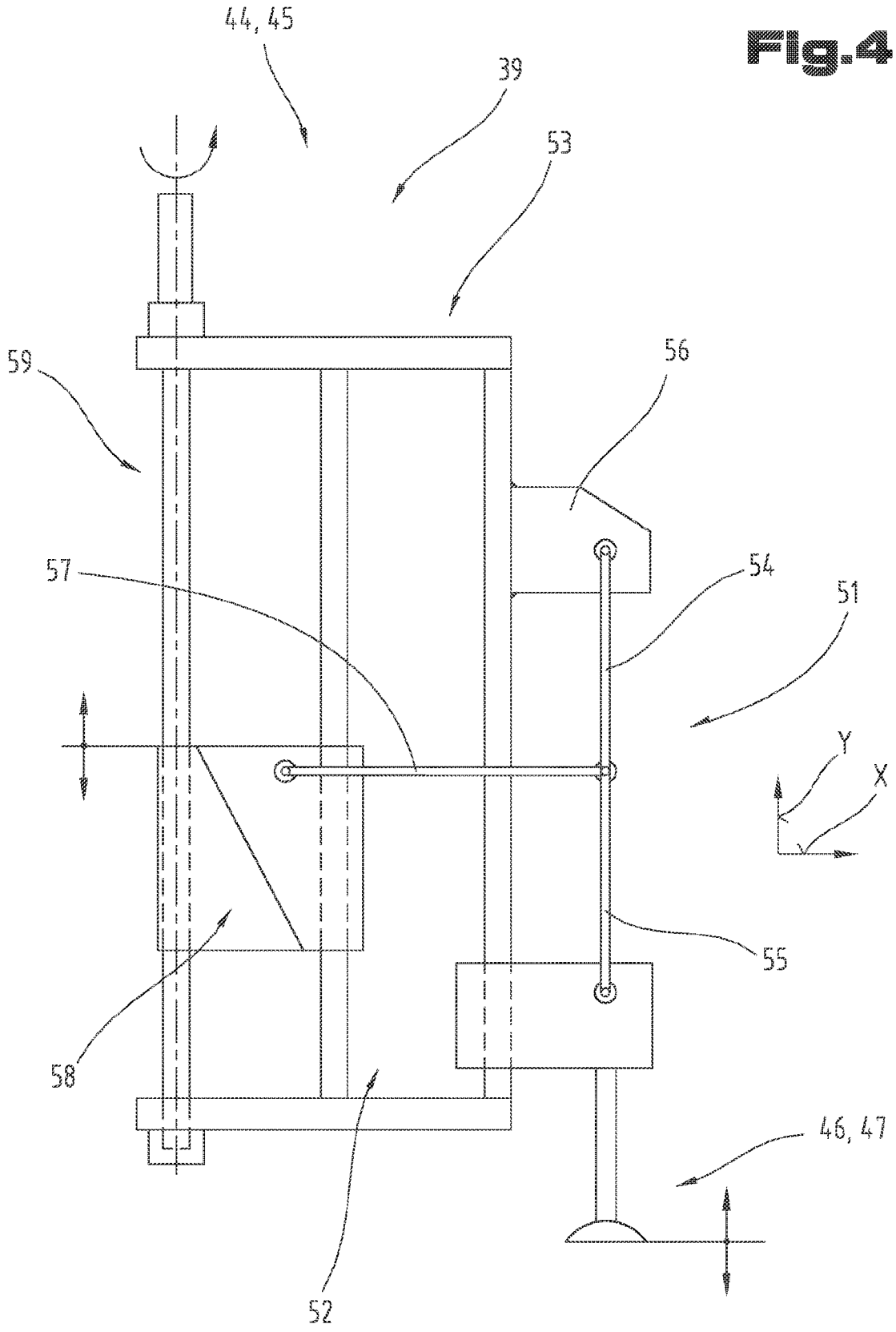

The figures show, each in a greatly simplified, schematic representation:

FIG. 1 a bending machine of a production system, with the support table removed and the manipulation apparatus removed, in a front view;

FIG. 2 the production system according to FIG. 1, with a manipulation apparatus indicated in simplified manner, in a side view;

FIG. 3 a possible embodiment of the manipulation apparatus, in a stylized representation, in a side view;

FIG. 4 a possible embodiment of a holding unit, in a stylized representation, in a side view.

As an introduction, it should be stated that in the different embodiments described, the same parts are provided with the same reference symbols or the same component designations, wherein disclosures contained in the description as a whole can be applied analogously to the same parts having the same reference symbols or component designations. Also, the position information selected in the description, such as at the top, at the bottom, at the side, etc., for example, relates only to the figure being directly described and shown, and this position information must be applied analogously to a new position in the case of a change in position.

In the following, the term "in particular" is understood to mean that this can involve a possible more specific embodiment or a more detailed specification of an object or of a method step, but does not necessarily have to represent a compulsory, preferred embodiment or the same or a method of procedure.

In FIGS. 1 to 4, a production system 1 and components of the same are shown in highly schematic, simplified representations, which system is configured, in the present case, in particular for swivel bending or swing folding of workpieces 2 to be produced from sheet metal. In general, a metallic material is used as the starting material, which can be referred to as a flat material or as a flat element in its unformed state. Thus, the production system 1 can also be referred to as a swivel-bending system or swing-folding system.

The production system 1 used for bending in the present case comprises a bending machine 3, in particular a press, which is configured, among other things, for clamping holding of the workpieces 2 or worked parts to be produced from the sheet metal, between a clamping tool 4 that is adjustable relative to one another. In the case of the present exemplary embodiment, the clamping tool 4 comprises at least one lower clamping jaw 5, however, generally preferably at least multiple lower clamping jaws 5, and at least one upper clamping jaw 6, however, generally preferably at least multiple upper clamping jaws 6, which interact with it/them. The lower clamping jaw(s) 5 can also be referred to as a lower jaw, and the upper clamping jaw(s) 6 can also be referred to as an upper jaw.

In the case of such bending machines 3, fundamentally the direction that runs in a horizontal plane and in a perpendicular orientation with reference to the longitudinal expanse of the clamping jaws 5, 6 is referred to as the "X" direction in a coordinate system. Therefore it is this direction that corresponds to the feed direction or the removal direction.

The "Y" direction is understood to be the direction that therefore runs in the height direction of the clamping jaws 5, 6. Finally, the "Z" direction is understood to be the direction that runs in the longitudinal direction or in the longitudinal expanse of the clamping jaws 5, 6. Therefore the longitudinal expanse of the bending edge, which will still be described below, is also oriented to run in the "Z" direction. These indicated directions ("X," "Y," and "Z") also define spatial axes, in each instance.

In this regard, the at least one upper clamping jaw 6 is disposed on the bending machine 3 above the workpiece 2 to be produced, and is held sufficiently there, in particular clamped. The at least one lower clamping jaw 5 is also held on the bending machine 3, in particular clamped.

A machine frame 7 of the bending machine 3 comprises side walls 9, 10 that project vertically upward from a floor plate 8, spaced apart from one another and oriented parallel to one another, for example. These are preferably connected with one another at their end regions that are at a distance from the floor plate 8, by means of a solid transverse brace 11 formed from a formed sheet-metal part. The machine frame 7 is generally a solid component of the bending machine 3, which component is preferably fixed in place on a level building floor. The form shown here has merely been selected as an example for a plurality of other possible embodiments.

The side walls 9, 10 can preferably be configured approximately in C shape so as to form a free space for forming of the workpiece 2, wherein a fixed lower clamping beam 13 is attached, in particular standing on the floor plate 8, on front end faces 12 of shanks of the side walls 9, 10, which shanks are close to the floor, which beam can also be referred to as a pressing beam. This lower clamping beam 13, which is preferably disposed in locally fixed manner and fixed in place, can also be referred to as a clamping table, on which parts of the clamping tool 4 (in particular the lower clamping jaws 5) are also disposed and also held on it. An upper clamping beam 16, in particular a pressure beam, which is adjustable relative to the lower clamping beam 13, is mounted in guided manner on front end surfaces 14, on shanks that are at a distance from the floor plate 8, in clamping beam guides 15. The clamping beam guides 15 are generally configured as linear guides in the most varied embodiments. This upper clamping beam 16 can also be referred to as a pressing beam, but it is guided on the machine frame 7 so as to be displaceable relative to it. Clamping jaw holders 19, 20 for being fitted out with the clamping jaw tool(s) 4, in particular the lower and upper clamping jaws 5, 6, can be disposed on end faces 17, 18 of the two clamping beams 13, 16, which faces run parallel to one another. The clamping tool(s) 4 can also be held on the clamping jaw holders 19, 20 with the interposition of an adapter, not shown in any detail.

The bending machine 3 shown can have at least one drive means 22 operated with electrical energy as a drive arrangement 21 for the adjustable upper clamping beam 16, namely the pressure beam. The drive means 22 is/are line-connected with a control apparatus 24 supplied from an energy network 23. For example, operation of the bending machine 3 can be controlled by way of an input terminal 25 that is line-connected with the control apparatus 24.

The drive means 22 are preferably spindle drives 26 driven by an electric motor, as they are generally known, setting means 27 of which are connected, for example drive-connected with an upper clamping beam 16 formed by the pressure beam, for a reversible setting movement of this beam. However, other drive means 22 known from the state of the art, such as cylinder/piston arrangements, stepper motors, rack and pinion drives or the like, for example, can also be used.

Other details required for operation of such a bending machine 3, such as safety devices, stop arrangements and/or control apparatuses, for example, are left out in the present description, so as to avoid unnecessary length of the description.

Furthermore, it is also shown, in simplified manner, that the two clamping beams 13, 16, in particular their tool holders 19, 20, or the clamping tool 4 held on them, with its/their lower and upper clamping jaws 5, 6, define an adjustment plane 28 that extends between the clamping beams 13, 16 when viewed in their longitudinal direction. The adjustment plane 28 preferably runs centered with reference to the clamping beams 13, 16 or the clamping jaw holders 19, 20 disposed on them. In the present exemplary embodiment, a vertically oriented plane is understood to exist here, which is defined by the two directions or axes described above, namely the "Y" axis and the "Z" axis. The two clamping jaws 5, 6 form a clamping region 29 between themselves and on ends that face one another. Lower and upper clamping surfaces 30, 31 of the two clamping jaws 5, 6, which surfaces face one another, are preferably oriented at a right angle with reference to the adjustment plane 28. These clamping surfaces 30, 31 serve to hold the metal sheet in position between the two clamping jaws 5, 6, as a function of its wall thickness, for carrying out the bending procedure.

An additional support table 32 with its support surface that defines a support plane 33 is preferably disposed in the region of the front side or of the charging side of the bending machine 3. The support plane 33 can also be referred to as a supporting plane. In this regard, it should be mentioned that the support surface does not need to be configured over the full area, but rather can also be formed from multiple partial support surfaces disposed next to one another and/or one behind the other in the feed direction of the metal sheet to be processed. The support surface defined by the support plane 33 is preferably disposed in the same plane as the lower clamping surface 30 of the lower clamping jaw 5. In the case of metal sheets having a larger area, this serves as additional support so as to prevent unintentional bending and, as a result, damage in the case of thinner metal sheets.

In this regard, a bending region 34 is understood to be the region that serves for forming the finished workpiece 2 from the metal sheet that is generally present in planar form and has not yet been formed, or to process an already pre-formed workpiece 2 further, in that generally, an additional fold is formed.

In this regard, the bending region 34 generally lies at a distance from the adjustment plane 28 of the clamping beams 13, 16, and is formed by means of end sections of at least one, but preferably both clamping jaws 5, 6, which sections face one another. In the present exemplary embodiment, the bending region 34 is disposed on the side of the clamping beams 13, 16 that face away from the support table 32 or from an operator, not shown in any detail. As a result, the bending region 34 is disposed to run within the machine frame 7.

The bending region 34 generally forms a bending line that preferably runs in a straight line on the workpiece 2 to be produced, wherein shanks form on both sides of the bending region 34 as the result of the bending procedure that has been carried out. One of the shanks of the workpiece 2 is held in the clamping position between the two clamping surfaces 30, 31 of the clamping jaws 5, 6, wherein the at least one further shank is disposed outside of the clamping surfaces 30, 31. Depending on the desired geometry of the workpiece 2, i.e. the geometry to be produced, the two shanks enclose a bending angle between them. This bending angle is measured in a reference plane oriented perpendicular with reference to the bending line. The reference plane in turn is furthermore preferably also oriented to run in the perpendicular direction with reference to the adjustment plane 28.

In this regard, it should be mentioned that the machine frame 7 of the bending machine 3 is shown only in greatly simplified manner, wherein it is also possible to use embodiments that deviate from it. Thus, for example, the machine frame 7 or the machine body could be configured with a free distance between uprights. In this case, it would be possible to hold the clamping jaw holders 19, 20 between the side walls 9, 10 or side parts. In another embodiment of the machine frame 7 or of the machine body, no free distance between uprights is possible, and therefore the clamping jaw holders 19, 20 could not be held between the side walls 9, 10 or side parts.

To carry out the bending procedure, the bending machine 3 of the production system 1 also comprises a bending unit 35, which can also be referred to as a press-braking unit or forming unit. A possible embodiment of the same is indicated in simplified manner in FIG. 2, and can be adjusted, depending on the bending procedure to be carried out, relative and with reference to the machine frame 7 for this purpose. For the sake of better clarity, representation of the bending unit 35 and its components was left out in FIG. 1.

In this regard, the metal sheet that is pre-positioned between the two clamping jaws 5, 6 and held in clamped manner can be formed, in particular press-braked, to form the workpiece 2 by means of a bending procedure, in particular a press-braking procedure, along the bending line that forms the bending region 34.

Depending on the press-braking to be carried out on the metal sheet held in clamped manner between the clamping jaws 5, 6, to produce the workpiece 2, either the lower clamping jaw 5 or the upper clamping jaw 6 forms the press-braking region and thereby the bending region 34. Thus, the lower clamping jaw 5 forms or has a first forming edge. The upper clamping jaw 6 forms or has a second forming edge.

The two clamping surfaces 30, 31 of the clamping jaws 5, 6, as described above, define a workpiece support plane 36 for the workpiece 2 to be produced in the position in which they lie against one another. Preferably, the workpiece support plane 36 is disposed at the same height as the support plane 33 defined by the support table 32, viewed in the vertical direction. The two planes are preferably oriented to run plane-parallel with one another, and can be disposed in a common plane.

The bending unit 35 can have one or also multiple bending tools 37, which can be disposed on a bending beam 38. The bending beam 38 can also be adjustable relative to the machine frame 7, on bending beam guides that are not shown in any detail, by means of a bending beam drive. However, only one bending tool 37 that can be pivoted parallel with reference to the bending region 34 could also be provided, which can be disposed alternately above the workpiece support plane 36 and below the workpiece support plane 36, depending on the desired bending direction, and is oriented to point the end of the bending tool 37 provided for bending in the direction of the bending region, in each instance.

Furthermore, it is also shown in FIGS. 1 and 2, in simplified manner, that the production system 1 can also comprise a manipulation apparatus 39 for manipulation of metal sheets that are generally planar and of workpieces 2 that are already pre-bent and to be processed further. The manipulation apparatus 39 will still be described in greater detail in the following.

The manipulation apparatus 39 in turn comprises a support arrangement 40 with an individual upper support unit 41 and an individual lower support unit 42. Here, individual support unit 41, 42 is understood to mean that these are fundamentally structural units that are independent of one another. The upper support unit 41 in turn can be disposed directly on the machine frame 7 and/or also on the upper clamping beam 16, and preferably connected in a fixed manner. The lower support unit 42 in turn can also be disposed directly on the machine frame 7 and/or also on the lower clamping beam 13, and preferably connected with it in a fixed manner.

The two support units 41, 42 preferably project from the bending machine 3, in particular its machine frame 7, toward the side respectively toward the direction facing away from the bending region 34 in the direction toward the operating side or charging side. Furthermore, the two support units 41, 42 are disposed at a distance from one another in the vertical direction, in other words in the perpendicular direction with reference to the workpiece support plane 36 or the support plane 33. The mechanical connection or reciprocal holding and support of the two support units 41, 42 is formed by the machine framework or the machine frame 7. The support plane 33 defined by the support table 32 is thereby not intersected by any of the support units 41, 42, and they do not project through it. In this way, a large-area free operating space or insertion space can be created in the feed region.

Furthermore, it is also provided here that the upper support unit 41 is disposed above the support plane 33, and the lower support unit 42 is disposed below the support plane 33. In this way, the upper support unit 41 is disposed completely above the support plane 33, at least in a charging region or feed region situated in front of the bending machine 3, and in the case of an open insertion position for holding the metal sheet to be manipulated or the workpiece 2 to be produced. In the same open insertion position for introduction of the metal sheet or of the workpiece 2, the lower support unit 42 is disposed completely below the support plane 33.

Furthermore, the manipulation apparatus 39 also comprises a holding arrangement 43, which holding arrangement 43 in turn can comprise an upper holding unit 44 and a lower holding unit 45. In order to achieve a clamping effect for the metal sheet to be manipulated or for the workpiece 2, the two holding units 44, 45 are configured or provided for interaction. Interaction is understood to mean that the two holding units 44, 45 are configured and disposed relative to one another or can be disposed relative to one another in such a manner that a sufficient clamping effect can be exerted on the metal sheet situated between the two holding units 44, 45 for its manipulation. Thus, the two holding units 44, 45 could also be referred to as clamping units. The manipulation apparatus 39 is configured so as to be adjustable for manipulation of the metal sheet or of the workpiece 2 to be produced, from an open insertion position into a clamping position in which it clamps the metal sheet or the workpiece 2. In particular, adjustment of at least one of the holding units 44, 45 in the direction toward the respective oppositely disposed other holding unit 45, 44 takes place.

In the present exemplary embodiment, the upper holding unit 44 is disposed on the upper support unit 41, and the lower holding unit 45 is disposed on the lower support unit 42. Furthermore, it is also provided that the holding units 44, 45 disposed on the respective support unit 41, 42 are also disposed, in an open insertion position of the manipulation apparatus 39, for holding the metal sheet to be manipulated or the workpiece 2 to be produced, and in a charging region in front of the bending machine 3, alternately completely above the support plane 33 and completely below the support plane 33. Since the upper holding unit 44 is disposed on the upper support unit 41, the latter is also situated completely above the support plane 33 in the open insertion position described above. However, the same also holds true for the placement of the lower holding unit 45 on the lower support unit 42, wherein then, the lower holding unit 45 is disposed completely below the support plane 33. Thus, it is also guaranteed that at least in the open insertion position, none of the holding units 44, 45 intersects the support plane 33 or projects beyond it.

It can also be provided that the upper holding unit 44 is guided on the upper support unit 41 in adjustable manner. In this regard, preferably an adjustment direction can be selected in which the upper holding unit 44 is configured to be adjustable in a perpendicular direction with reference to the bending region 34 defined by at least one of the clamping jaws 5, 6, and in the parallel direction with reference to the support plane 33, and also guided in it. For the sake of better clarity, representation of a drive unit was left out.

It is furthermore advantageous if the lower holding unit 45 is also guided on the lower support unit 42 in adjustable manner. Here, too, once again an adjustment direction can be selected in which the lower holding unit 45 is configured to be adjustable in a perpendicular direction with reference to the bending region 34 defined by at least one of the clamping jaws 5, 6, and in the parallel direction with reference to the support plane 33, and also guided in it. For the sake of better clarity, representation of drive units was left out.

By means of the spatial separation of the two support units 41, 42 with the holding units 44, 45 disposed on them, in each instance, the two holding units 44, 45 are supposed to be guided on a guide arrangement, in each instance, which is not indicated in any greater detail, so as to be adjustable jointly and synchronous to one another. In this way, reliable manipulation of the metal sheet or of the workpiece 2 to be processed further can be achieved.

As can now be seen better in FIG. 3, in this representation the components of the manipulation apparatus 39 that were shown in simplified manner previously are now shown on a larger scale and also in stylized simplified manner.

The manipulation apparatus 39 shown here in simplified and stylized manner comprises the support arrangement 40 with the upper support unit 41 and the lower support unit 42. Each of the two support units 41, 42 is disposed on a machine frame 7, indicated only schematically, and/or on one of the clamping beams 13, 16. For the sake of better clarity, representation of the attachment was left out. As has already been described above, the upper support unit 41 can be disposed and attached either directly on a component of the fixed machine frame 7 or also on the upper clamping beam 16. When the upper support unit 41 is attached to the upper clamping beam 16, the upper support unit 41 joins in all the adjustment movements of the upper clamping beam 16. In this regard, attention must be paid to the design of the setting movements of the upper holding unit 44 with reference to the position of the metal sheet or workpiece 2 to be processed. The lower support unit 42 can also be disposed either directly on the machine frame 7 and/or also on the lower clamping beam 13, in particular attached in locally fixed manner.

It would also be possible that the support unit 41, 42 is attached directly to the machine frame 7, but is disposed in front of the clamping bar 13, 16 in terms of its position. In this case, passages or perforations adapted to the attachment means selected, in each instance, must be provided in the clamping beam 13 and/or 16, so that on the one hand, attachment is guaranteed, and on the other hand, an unhindered adjustment movement of the clamping bar 13 and/or 16 can be carried out by the bending machine.

The upper holding unit 44 comprises at least one upper holding element 46, which serves or is configured for the purpose of being able to enter into clamping contact with the metal sheet or the workpiece 2.

The lower holding unit 45 in turn comprises at least one lower holding element 47. The two holding elements 46, 47 are shown in simplified manner and can be adjusted on the respective support unit 41, 42, together with the respecting holding unit 44 and/or 45, in the perpendicular direction with reference to the bending region 34 defined by at least one of the clamping jaws 5 and/or 6, as well as in the parallel direction with reference to the support plane 33. This is shown in simplified manner by means of double arrows, in each instance.

The holding elements 46, 47 can be configured differently and fundamentally serve for contacting with a flat side of the metal sheet or workpiece 2, in each instance. Furthermore, it would be possible to support the holding elements 46, 47 on the metal sheet or workpiece with the interposition of a spring element or pressure element. It would also be possible to provide a contact head of the holding element 46, 47, which head comes to lie against the metal sheet or the workpiece 2, with at least one suction inlet, which inlet stands in a line connection with a partial vacuum generator. Another possibility would also consist in equipping the contact head with a magnet, so as to be able to hold those materials that can be attracted by a magnet on the respective holding element 46, 47 for manipulation, by means of the magnetic holding force.

In order to be able to carry out a change in orientation of the metal sheet or workpiece 2 to be fed in, with reference to the bending region 34, at least one of the holding elements 46, 47 can be configured so as to pivot or rotate about an axis of rotation 48 and/or 49 oriented in the perpendicular direction with reference to the support plane 33. Thus, in this exemplary embodiment, the upper holding element 46 has the upper axis of rotation 48. The lower holding element 47 in turn has the lower axis of rotation 49. For reciprocal clamping holding of the two holding elements 46, 47, these are brought into contact with the metal sheet or the workpiece 2 to be processed, in each instance, wherein here, an orientation of the two axes of rotation 48, 49 in which they preferably align with one another should be provided.

For carrying out the rotational or pivoting movement of at least one of the holding elements 46, 47, this element can be equipped with a pivoting drive, not shown in any greater detail, or can stand in a drive connection with it. The extent of the pivoting of the metal sheet or of the workpiece 2 about one of the axes of rotation 48 and/or 49 can be transferred precisely to the pivoting drive, by means of sensitive controllers.

Furthermore, it is also shown that at least one of the holding elements 46 and/or 47 is configured to be adjustable in the perpendicular direction with reference to the support plane 33, in the direction toward the other holding element 47, 46 disposed to lie opposite with reference to the support plane 33, in each instance. This is also indicated with double arrows.

Furthermore, it is also shown, in the region of the lower support unit 42, that a lower support element 50 can be disposed on this unit. In this regard, the lower support element 50 can represent a component of the lower holding unit 45. The lower support element 50 serves for the purpose of providing an additional support effect for the metal sheet or workpiece 2 to be processed. Furthermore, the support element 50 can be guided in a guide arrangement so as to be adjustable on the lower support unit 41. In this regard, the adjustment movement preferably takes place in the perpendicular direction with reference to a bending region 34, defined by at least one of the clamping jaws 5, 6, and in the parallel direction with reference to the support plane 33. For the sake of better clarity, representation of the corresponding guides and drive components has been left out. Furthermore, the adjustment movement of the lower support element 50 can preferably take place independent of the adjustment movement of the lower holding element 47. It should be mentioned that the lower support element 50 can also be configured and disposed in such a manner that it is also disposed in the open insertion position of the manipulation apparatus for holding the metal sheet to be manipulated or the workpiece to be produced, and, in a charging region in front of the bending machine, completely below the support plane 33, or a support surface formed by the support element 50 is disposed to lie in the support plane 33.

It would also be possible that at least one partial component of the lower support element 50 is configured to be adjustable, in the perpendicular direction, with reference to the support plane 33, in the direction toward the upper support unit 41 that is disposed to lie opposite with reference to the support plane 33. In this way, height adjustment for the metal sheet to be supported or the workpiece 2 to be processed can take place. This adjustment movement of the partial component of the support element 50, which movement is possible in the vertical direction, can take place independent of the adjustment movement of the lower holding element 47 that takes place in the same direction. Because the lower holding element 47 is guided on the lower support unit 42 in adjustable manner, independent of the lower support element 50, an adjustment movement can also be carried out independent of one another.

The lower support element 50 can also serve for the purpose of supporting the metal sheet held in clamped manner for the bending procedure, or the workpiece 2 to be processed further, between the two clamping jaws 5, 6, on the side of the clamping jaws 5, 6 facing away from the bending region 34. In the meantime further metal sheet or workpiece 2 to be processed can already be pre-positioned in the region of the support table 32 for the subsequent bending procedure, by the manipulation apparatus 39, with the two holding units 44, 45. In this regard, a pivoting procedure can also be carried out by at least one of the holding elements 46, 47, so as to thereby dispose the metal sheet or the workpiece 2 in such a manner, in terms of its orientation, that the planned bending line on the metal sheet or workpiece 2 is oriented to run approximately or already precisely parallel to the bending region 34. Once the bending procedure has been carried out on the metal sheet or workpiece 2 already held clamped between the clamping jaws 5, 6, this metal sheet or workpiece can be removed to the side or in the parallel direction with reference to the bending region 34, for example by pushing it away, and directly subsequently, the already prepared and pre-positioned further metal sheet or workpiece 2 can be brought between the open clamping jaws 5, 6 by the holding units 44, 45, to carry out the subsequent bending procedure.

However, it would also be conceivable that the upper holding unit 44, for example, in particular its upper holding element 46, does not interact with the lower holding element 47 for clamping the metal sheet or the workpiece 2, but rather interacts with the lower support element 50.

The adjustment movement or adjustment direction of the two holding units 44, 45 on the respective support units 41, 42 takes place, in this regard, preferably exclusively in the "X" direction. The adjustment movement of the holding elements 46, 47, in terms of height, as well as, if applicable, of the lower support element 50, preferably takes place exclusively in the "Y" direction.

The complete arrangement of the respective support unit 41, 42, and of the holding units 44 or 45 disposed on it/them, in adjustable manner, as described above, in each instance, either above the support plane 33 or below the support plane 33, should be understood in such a manner that in the case of a planar position of the metal sheet to be processed in the support plane 33, none of the two components or component parts described above projects beyond this plane. It is essential, in this regard, that no reciprocal connection exists between the two support units 41, 42 in the feed region or charging region situated in front of the clamping jaws 5, 6, and therefore sufficient free space is formed without interruptions. The two support units 41, 42 are configured independent of one another, and are each held on or attached to the bending machine 3 directly, separately from one another.

A possible arrangement or configuration of one of the holding units 44 and/or 45, which can be independent, if applicable, is shown in FIG. 4, which can represent an independent solution on its own, if applicable. So as to avoid unnecessary repetition, reference is made to the detailed description in the previous FIGS. 1 to 3, i.e. this is pointed out. Furthermore, the same component designations are used for the same parts as in the previous FIGS. 1 to 3.

The adjustment movement to be carried out in the "Y" direction by the holding unit 44, 45, in particular its/their holding elements 46, 47, can be implemented by a toggle lever arrangement 51 in interaction with a longitudinal guide arrangement 52.

The holding unit 44, 45 in turn comprises a base frame 53, on which the holding element 46, 47 is guided in adjustable manner. The toggle lever arrangement 51 comprises a first toggle lever 54 and a second toggle lever 55. The two toggle levers 54, 55 are connected with one another in articulated manner at ends that face one another. The further end of the first toggle lever 54, which faces away from the common connection region of the two toggle levers 54, 55, is connected with the base frame 53 in locally fixed but articulated manner, for example by means of a bracket 56. A further end of the second toggle lever 55, facing away from the connection region of the two toggle levers 54, 55, is connected with the holding element 46, 47 that is to be adjusted, in articulated manner.

A setting lever 57 is disposed or attached in articulated manner in the connection region between the first toggle lever 54 and the second toggle lever 55. Furthermore, a setting element 58 is also guided on the base frame 53, also so as to be adjustable in the "Y" direction. The setting lever 57 is furthermore connected with the setting element 58, in articulated manner. In the completely extended position of the first toggle lever 54 and of the second toggle lever 55 shown here, the setting lever 57, for example, can assume a parallel orientation with reference to the support plane 33.

Furthermore, it is also shown that the setting element 58 stands in a drive connection with an actuator 59, for example a ball screw or the like, and the setting element 58 can be adjusted and guided in the "Y" direction along the base frame 53, by means of the actuator 59. Because of this adjustment movement and the placement of the setting lever 57 between the setting element 58 and the two toggle levers 54, 55 that are connected with one another in articulated manner, displacement of the holding element 46, 47 can be achieved in the case of a displacement of the setting element 58 to the side facing away from the support plane 33. If the adjustment of the holding element 46, 47 takes place in the "Y" direction and to the side facing away from the support plane 33, the clamping effect of the holding element 46, 47 can be cancelled out from the metal sheet or workpiece 2. In the case of an opposite adjustment movement of the setting element 58, directed in the direction toward the support plane 33, the holding element 46, 47 is moved into its clamping position and brought to lie against the metal sheet.

In this regard, it should be noted that the configuration and placement of the components described above was presented only as an example and in highly stylized manner. The adjustment movement of the holding elements 46 and/or 47, which mainly takes place or is to be carried out in the vertical direction, could, however, also take place by means of rack and pinion drives, cylinder/piston arrangements, cam adjusters, or other drive elements.

The exemplary embodiments show possible embodiment variants, wherein it should be noted at this point that the invention is not restricted to the specifically represented embodiment variants of the same, but rather various combinations of the individual embodiment variants with one another are also possible, and this variation possibility lies within the ability of a person skilled in the art of this technical field, on the basis of the teaching for technical action provided by the present invention.

The scope of protection is determined by the claims. However, the description and the drawings must be used to interpret the claims. Individual characteristics or combinations of characteristics from the different exemplary embodiments shown and described can represent independent inventive solutions on their own. The task on which the independent inventive solutions are based can be derived from the description.

All information regarding value ranges in the present description should be understood to mean that these include any and all partial ranges of them; for example, the information 1 to 10 should be understood to mean that all partial ranges, proceeding from the lower limit 1 and also including the upper limit 10 are also included; i.e. all partial ranges start with a lower limit of 1 or more and end at an upper limit of 10 or less, for example 1 to 1.7, or 3.2 to 8.1, or 5.5 to 10.

For the sake of good order, it should be pointed out, in conclusion, that for a better understanding of the structure, some elements have been shown not to scale and/or larger and/or smaller.

REFERENCE SYMBOL LISTING

1 production system
2 workpiece
3 bending machine
4 clamping tool
5 lower clamping jaw
6 upper clamping jaw
7 machine frame
8 floor plate
9 side wall
10 side wall
11 transverse brace
12 front end face
13 clamping beam
14 front end face
15 clamping beam guide
16 clamping beam
17 end face
18 end face
19 clamping jaw holder
20 clamping jaw holder
21 drive arrangement
22 drive means
23 power network
24 control apparatus
25 input terminal
26 spindle drive
27 setting means
28 adjustment plane
29 clamping region
30 lower clamping surface
31 upper clamping surface
32 support table
33 support plane
34 bending region
35 bending unit
36 workpiece support plane
37 bending tool
38 bending beam
39 manipulation apparatus
40 support arrangement
41 upper support unit
42 lower support unit
43 holding arrangement
44 upper holding unit
45 lower holding unit
46 upper holding element
47 lower holding element
48 upper axis of rotation
49 lower axis of rotation
50 lower support element
51 toggle lever arrangement
52 longitudinal guide arrangement
53 base frame
54 first toggle lever
55 second toggle lever
56 bracket
57 setting lever
58 setting element
59 actuator

The invention claimed is:

1. A production system for production of workpieces made of sheet metal, comprising:

a bending machine having a machine frame that is fixed in place, a lower clamping beam having at least one lower clamping jaw held on it, as well as an upper clamping beam having at least one upper clamping jaw held on it, wherein one of the clamping beams is adjustable relative and with reference to the machine frame, so as to clamp a workpiece to be produced between the lower clamping jaw and the upper clamping jaw, at least during a bending procedure, a support table, which support table has a support surface defining a support plane for a metal sheet or the workpiece to be produced, a manipulation apparatus having a support arrangement and having a holding arrangement, wherein the holding arrangement comprises an upper holding unit and a lower holding unit that interacts with the upper holding unit, and wherein the manipulation apparatus is adjustable for manipulation of the metal sheet or of the workpiece to be produced, from an open insertion position into a clamping position that clamps the metal sheet or the workpiece to be produced, wherein the support arrangement has an individual upper support unit and an individual lower support unit, the upper support unit is disposed above the support plane, the lower support unit is disposed below the support plane, the upper holding unit is guided on the upper support unit and can be adjusted by means of a first drive unit, the lower holding unit is guided on the lower support unit and can be adjusted by means of a second drive unit, the upper holding unit is disposed on the machine frame and/or on the upper clamping beam, the lower holding unit is disposed on the machine frame and/or on the lower clamping beam, in an insertion position of the manipulation apparatus, which position is open to hold the metal sheet to be manipulated or the workpiece to be produced, as well as in a charging region in front of the bending machine, the upper support unit, together with the upper holding unit, is disposed completely above the support plane, and the lower support unit, together with the lower holding unit, is disposed completely below the support plane, and the upper support unit and the lower support unit are not connected at their respective distal end-sections with respect to the bending machine, so that a free manipulation space, without interruptions, for holding and manipulation of the workpiece to be processed is present in a front region of the bending machine, which front region begins at the bending machine, extends between and parallel to the upper support unit and the lower support unit, and reaches beyond respective distal ends of the upper support unit and the lower support unit with respect to the bending machine.

2. The production system according to claim 1, wherein the upper holding unit is configured to be adjustable in the perpendicular direction with reference to a bending region defined by at least one of the lower clamping jaw and the upper clamping jaw, and in the parallel direction with reference to the support plane.

3. The production system according to claim 1, wherein the lower holding unit is configured to be adjustable in the perpendicular direction with reference to a bending region by at least one of the lower clamping jaw and the upper clamping jaw, and in the parallel direction with reference to the support plane.

4. The production system according to claim 1, wherein the upper holding unit and the lower holding unit are guided so as to be adjustable jointly and synchronous to one another.

5. The production system according to claim 1, wherein the upper holding unit has at least one upper holding element, and the lower holding unit has at least one lower holding element.

6. The production system according to claim 5, wherein at least one of the upper holding element and the lower holding element can be pivoted about an axis of rotation oriented in the perpendicular direction with reference to the support plane.

7. The production system according to claim 5, wherein at least one of the upper holding element and the lower holding element is configured to be adjustable in the perpendicular direction with reference to the support plane, in the direction toward the other of the upper holding element and the lower holding element that lies opposite with reference to the support plane, in each instance.

8. The production system according to claim 1, wherein the lower holding unit furthermore comprises a lower support element, and the lower support element is guided to be adjustable on the lower support unit in the perpendicular direction with reference to a bending region defined by at least one of the lower clamping jaws, and in the parallel direction with reference to the support plane.

9. The production system according to claim 8, wherein the lower support element is configured to be adjustable in the perpendicular direction with reference to the support plane, in the direction toward the upper support unit disposed opposite with reference to the support plane.

10. The production system according to claim 8, wherein the lower holding element is guided to be adjustable on the lower support unit, independent of the lower support element.

11. The production system according to claim 5, wherein at least one of the upper holding unit and the lower holding unit, has a toggle lever arrangement, operable to adjust at least one of the at least one upper holding element and the at least one lower holding element in the perpendicular direction with reference to the support plane, from the open insertion position into the clamping position.

* * * * *